US011235573B2

(12) United States Patent
Tatematsu

(10) Patent No.: US 11,235,573 B2
(45) Date of Patent: Feb. 1, 2022

(54) LIQUID EJECTION APPARATUS AND STORAGE MEDIUM STORING PROGRAM

(71) Applicant: BROTHER KOGYO KABUSHIKI KAISHA, Nagoya (JP)

(72) Inventor: Yuya Tatematsu, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/010,093

(22) Filed: Sep. 2, 2020

(65) Prior Publication Data

US 2021/0094289 A1 Apr. 1, 2021

(30) Foreign Application Priority Data

Sep. 30, 2019 (JP) ..... JP2019-180722

(51) Int. Cl.
*B41J 2/045* (2006.01)
*B41J 2/15* (2006.01)
*B41J 11/00* (2006.01)

(52) U.S. Cl.
CPC ..... *B41J 2/04586* (2013.01); *B41J 2/15* (2013.01); *B41J 11/007* (2013.01)

(58) Field of Classification Search
CPC ..... B41J 2/04586; B41J 2/15; B41J 11/007
See application file for complete search history.

(56) References Cited

U.S. PATENT DOCUMENTS

2004/0080555 A1* 4/2004 Otsuki ..... B41J 19/145 347/14
2009/0251503 A1 10/2009 Kashimoto

FOREIGN PATENT DOCUMENTS

JP 2009-234071 A 10/2009

* cited by examiner

*Primary Examiner* — Thinh H Nguyen
(74) *Attorney, Agent, or Firm* — Scully, Scott, Murphy & Presser, PC

(57) ABSTRACT

In response to determining that a code image is to be formed such that a particular direction is same as a scanning direction, a controller performs divided recording processing of controlling a head and a carriage to: (a) record a plurality of first portions with liquid ejected from the head during a first movement of the head in the scanning direction; and (b) record a plurality of second portions with liquid ejected from the head during a second movement of the head in the scanning direction. The plurality of second portions are located at an at least partially different position from the plurality of first portions with respect to a conveyance direction. The second movement is a movement in a direction opposite the first movement. The second movement is performed after the first movement without performing conveyance processing between the first movement and the second movement.

17 Claims, 9 Drawing Sheets

LIQUID EJECTION APPARATUS AND STORAGE MEDIUM STORING PROGRAM

CROSS REFERENCE TO RELATED APPLICATIONS

This application claims priority from Japanese Patent Application No. 2019-180722 filed Sep. 30, 2019. The entire content of the priority application is incorporated herein by reference.

TECHNICAL FIELD

This disclosure relates to a liquid ejection apparatus configured to print a code image and a storage medium storing program.

BACKGROUND

The standard for one-dimensional codes (bar codes) defines the ratio of the width of a bar and the space between two adjacent bars. In a case where a barcode image is printed by using a liquid ejection apparatus such as an inkjet printer, if a part of a plurality of ejection ports for ejecting liquid has ejection malfunction such as deviation in the ejection direction, the ratio of the width of the bar and the space of the printed barcode image may out of the reference range. This causes a reading error.

A known serial-type ink jet printer has a function of adjusting a deviation amount of a landing position of a droplet that occurs in bidirectional printing in which an image is printed on a recording medium in both forward movement and reverse movement of a recording head mounted on a carriage. In this ink jet printer, an adjustment value is set for each dot size according to the amount of deviation of the landing position of the ink droplet between the forward movement and the reverse movement of the recording head.

SUMMARY

According to one aspect, this specification discloses a liquid ejection apparatus. The liquid ejection apparatus includes a head, a conveyor, a carriage, and a controller. The head has a plurality of ejection ports configured to eject liquid. The conveyor is configured to perform conveyance processing of conveying a recording medium in a conveyance direction. The head is mounted on the carriage. The carriage is configured to reciprocate in a scanning direction perpendicular to the conveyance direction. The controller is configured to: control the conveyor to convey the recording medium in the conveyance direction; determine whether a code image is to be formed on the recording medium such that a particular direction of the code image is same as the scanning direction, the particular direction being a direction in which a plurality of recorded regions and a plurality of non-recorded regions are formed alternately; and in response to determining that the code image is to be formed such that the particular direction is same as the scanning direction, perform divided recording processing of controlling the head and the carriage to: (a) record a plurality of first portions with liquid ejected from the head during a first movement of the head in the scanning direction, the plurality of first portions being respective portions of the plurality of recorded regions, the plurality of first portions being located at a same position with respect to the conveyance direction; and (b) record a plurality of second portions with liquid ejected from the head during a second movement of the head in the scanning direction, the plurality of second portions being respective portions of the plurality of recorded regions, the plurality of second portions being located at a same position with respect to the conveyance direction, the plurality of second portions being located at an at least partially different position from the plurality of first portions with respect to the conveyance direction, the second movement being a movement in a direction opposite the first movement, the second movement being performed after the first movement without performing the conveyance processing between the first movement and the second movement.

According to another aspect, this specification also discloses a non-transitory computer-readable storage medium storing a set of program instructions for a computer of an electronic device that controls a liquid ejection apparatus. The liquid ejection apparatus includes a head having a plurality of ejection ports configured to eject liquid, a conveyor configured to convey a recording medium in a conveyance direction, a carriage on which the head is mounted, the carriage being configured to reciprocate in a scanning direction perpendicular to the conveyance direction, and a controller configured to perform conveyance processing of controlling the conveyor to convey the recording medium in the conveyance direction. The set of program instructions, when executed by the computer, causes the electronic device to: determine whether a code image is to be formed on the recording medium such that a particular direction of the code image is same as the scanning direction, the particular direction being a direction in which a plurality of recorded regions and a plurality of non-recorded regions are formed alternately; and in response to determining that the code image is to be formed such that the particular direction is same as the scanning direction, perform divided recording processing of controlling the head and the carriage to: (a) record a plurality of first portions with liquid ejected from the head during a first movement of the head in the scanning direction, the plurality of first portions being respective portions of the plurality of recorded regions, the plurality of first portions being located at a same position with respect to the conveyance direction; and (b) record a plurality of second portions with liquid ejected from the head during a second movement of the head in the scanning direction, the plurality of second portions being respective portions of the plurality of recorded regions, the plurality of second portions being located at a same position with respect to the conveyance direction, the plurality of second portions being located at an at least partially different position from the plurality of first portions with respect to the conveyance direction, the second movement being a movement in a direction opposite the first movement, the second movement being performed after the first movement without performing the conveyance processing between the first movement and the second movement.

BRIEF DESCRIPTION OF THE DRAWINGS

Embodiments in accordance with this disclosure will be described in detail with reference to the following figures wherein:

FIG. 8A is an explanatory drawing for illustrating divided recording processing in a case where a one-dimensional code image is recorded by performing two passes of recording processing with one conveyance processing in between;

DETAILED DESCRIPTION

The inventor of this disclosure found that, in a serial-type ink jet printer, the amount of deviation of the landing position of liquid ejected from the recording head mounted on the carriage from the desired position in the scanning direction is not constant during forward movement or reverse movement but fluctuates with the movement of the carriage, and that the magnitude of the variation of the deviation amount is different between the forward movement and the reverse movement. For example, the amount of change in the tilt angle of the nozzle surface of the head during the forward movement may differ from the amount of change in the tilt angle of the nozzle surface of the head during the reverse movement. In this case, the variation in the amount of deviation of the liquid landing position from the desired position in the scanning direction differs between the forward movement and the reverse movement.

In this situation, when a one-dimensional code image in which a plurality of bars are arranged in the scanning direction (for example, a barcode image) is printed in one pass, if the recording is performed with the one having a large variation in ink landing accuracy in the scanning direction between forward movement and reverse movement, the ratio of the widths of the bar and the space of the barcode image may deviate from the reference range.

In view of the foregoing, an example of an object of this disclosure is to provide a liquid ejection apparatus configured to suppress an occurrence of a reading error even when printing a one-dimensional code image in which a plurality of bars are arranged in the scanning direction, and a storage medium storing program.

Hereinafter, embodiments of this disclosure will be described while referring to the accompanying drawings.

First Embodiment

Figure 1:
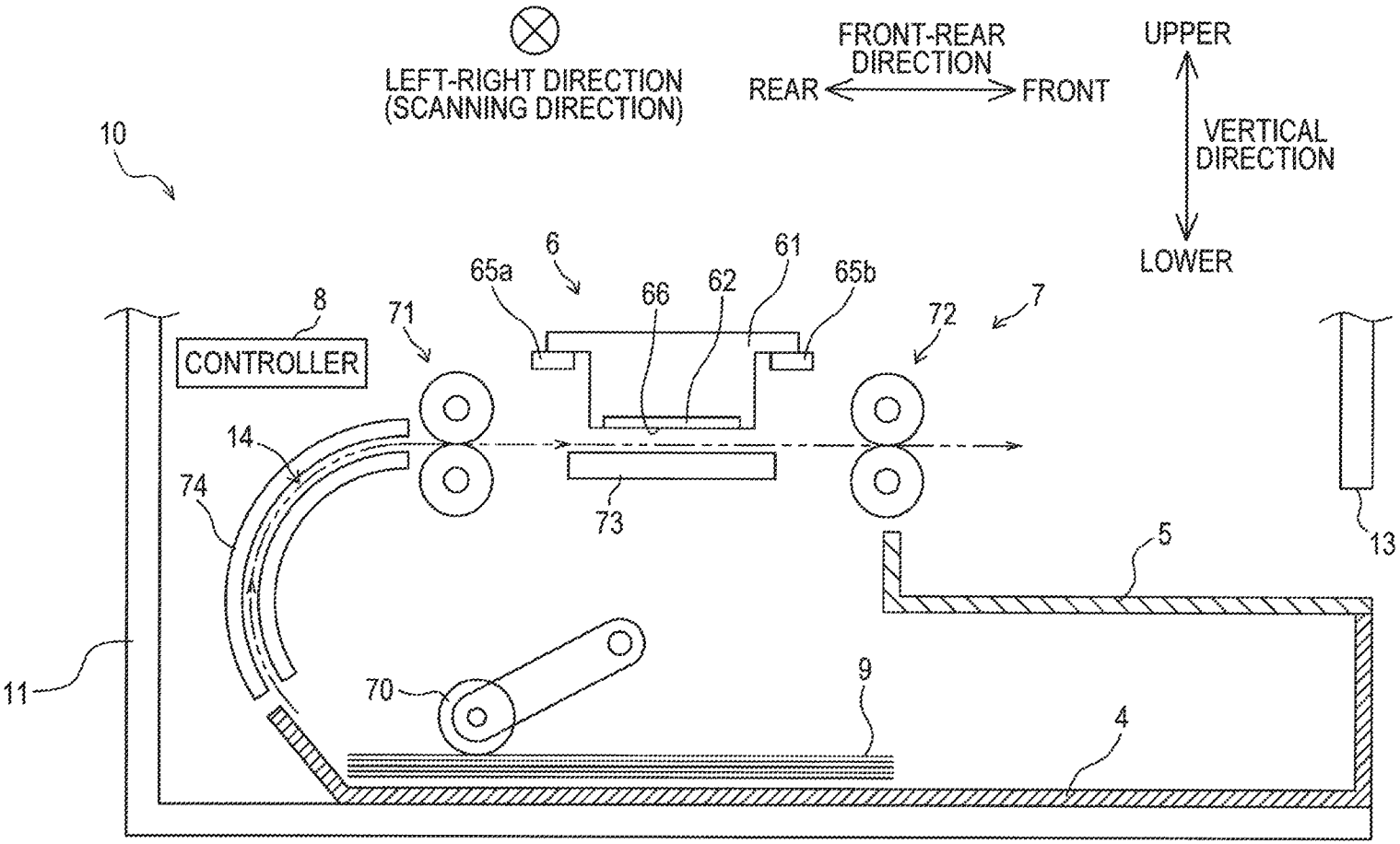
FIG. 1 is a schematic side view showing the internal structure of a printer according to a first embodiment of this disclosure.

First, a printer (liquid ejection apparatus) 10 according to a first embodiment will be described. As shown in FIG. 1, the printer 10 includes a paper feed tray 4, a paper discharge tray 5, a scanning mechanism 6, a conveyance mechanism 7, and a controller 8. In the following description, a vertical direction is defined based on the state where the printer 10 is installed in a usable state (state of FIG. 1). A front-rear direction is defined assuming that the side where the opening 13 of the housing 11 is provided is the near side (front side). Further, a left-right direction is defined when viewed from the near side (front side) of the printer 10. The paper feed tray 4, the scanning mechanism 6, the conveyance mechanism 7, and the controller 8 are housed in the housing 11 of the printer 10. The paper feed tray 4 is arranged below the scanning mechanism 6 in the housing 11.

The paper feed tray 4 is configured to support and accommodate a plurality of sheets of paper 9 in a stacked state. The paper feed tray 4 is configured to be inserted into and removed from the housing 11 in the front-rear direction. The paper discharge tray 5 accommodates the paper 9 on which an image is recorded by a recording head 62 of the scanning mechanism 6 described later. The paper discharge tray 5 is arranged above the front side of the paper feed tray 4, and is configured to move as the paper feed tray 4 is inserted into and removed from the housing 11.

Figure 2:
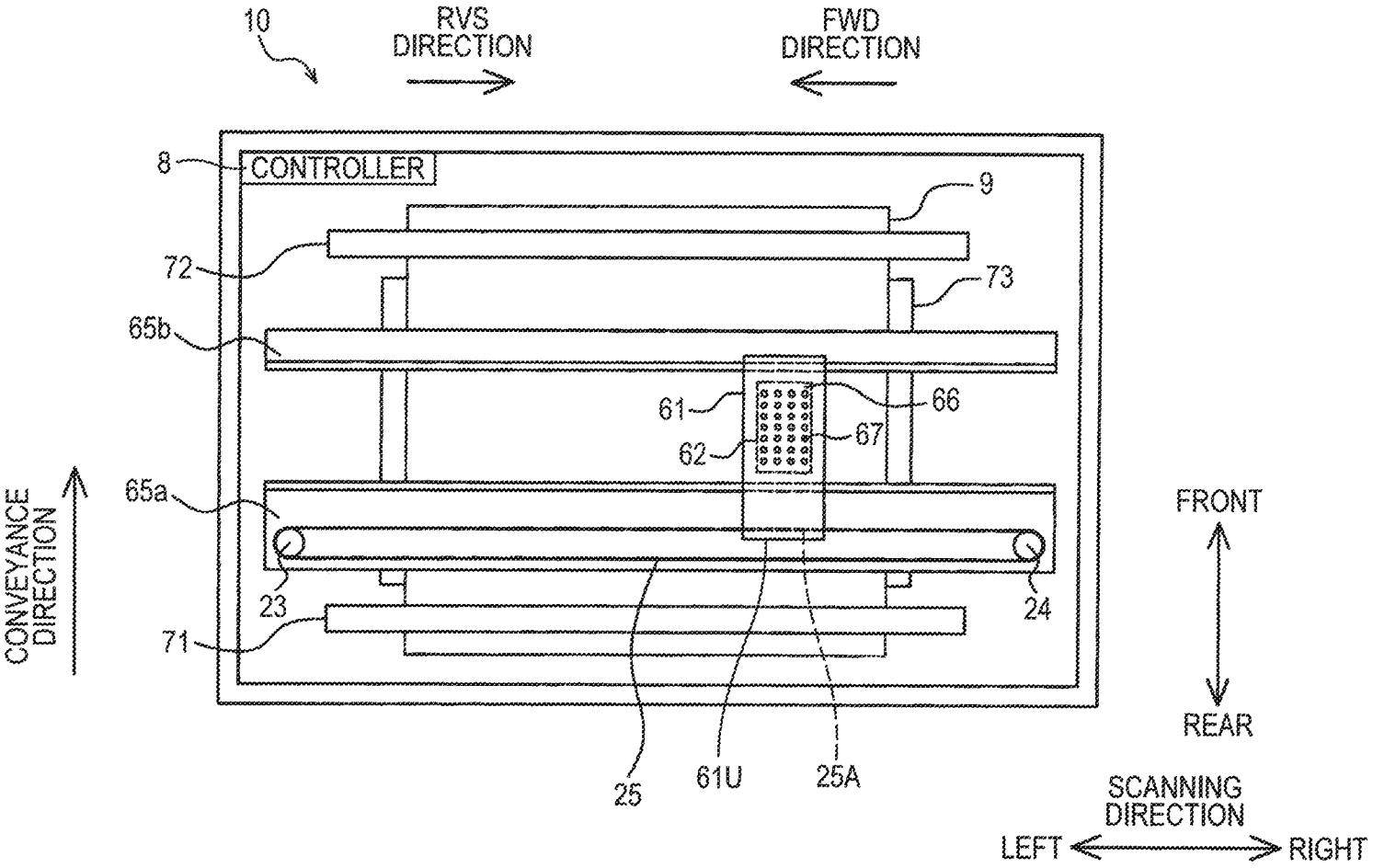
FIG. 2 is a schematic top view of the printer shown in FIG. 1.

The scanning mechanism 6 includes a carriage 61 and the recording head 62. As shown in FIGS. 1 and 2, the carriage 61 is supported by two guide rails 65*a* and 65*b* spaced away from each other in the front-rear direction and each extending in the left-right direction. Pulleys 23 and 24 are provided on both ends of the upper surface of the guide rail 65*a* in the left-right direction. An endless belt 25 made of a rubber material is wound around the pulleys 23 and 24. A part 25A of the belt 25 is fixed to an upstream end 61U of the carriage 61 in the conveyance direction (the rear end of the carriage 61 in the example of FIG. 2). A carriage motor 31 (see FIG. 3, an example of a drive source) is connected to the right-side pulley 24. When the carriage motor 31 is rotated in the forward direction and the reverse direction, the belt 25 is moved by rotation of the pulleys 23 and 24, and the carriage 61 reciprocates in the left-right direction as the scanning direction. More specifically, the carriage 61 moves in the forward (FWD) direction from the right end to the left end when the carriage motor 31 rotates in the forward direction, and moves in the reverse (RVS) direction from the left end to the right end when the carriage motor 31 rotates in the reverse direction. In the reciprocating movement in this embodiment, the movement in the FWD direction is referred to as "forward movement", and the movement in the RVS direction is referred to as "reverse movement".

The recording head 62 is mounted on the carriage 61 and reciprocates in the scanning direction together with the carriage 61. As shown in FIG. 2, a plurality of nozzles (ejection ports) 67 for ejecting ink are arranged on the nozzle surface 66 on the lower surface of the recording head 62 along the conveyance direction (the front-rear direction) perpendicular to the scanning direction. The nozzles 67 are arranged on the nozzle surface 66 in four rows, the four rows being arranged in the scanning direction. The recording head 62 ejects ink supplied from four ink cartridges (not shown) that store ink of four colors (black, cyan, magenta, and yellow) from each row of the nozzles 67, thereby recording an image on paper 9. That is, the printer 10 in this embodiment is an inkjet serial printer capable of recording a color image.

The conveyance mechanism 7 conveys the paper 9 inside the printer 10, and includes a paper feed roller 70, a pair of conveyance rollers 71, a pair of discharge rollers 72, a platen 73, and a guide member 74. The paper feed roller 70 is disposed above the paper feed tray 4, and is rotated by being applied with a driving force from a paper feed motor 32 (see FIG. 3), thereby sending the paper 9 accommodated in the paper feed tray 4 rearward. The pair of conveyance rollers 71 and the pair of discharge rollers 72 are arranged to sandwich the scanning mechanism 6 in the front-rear direction. The pair of conveyance rollers 71 is arranged at the rear of the scanning mechanism 6, and the pair of discharge rollers 72 is arranged at the front of the scanning mechanism 6. The pair of conveyance rollers 71 sends the paper 9 to a region facing the nozzle surface 66 of the recording head 62. The pair of discharge rollers 72 receives the paper 9 sent by the pair of conveyance rollers 71, and discharges the paper 9 to the paper discharge tray 5. The pair of conveyance rollers 71 and the pair of discharge rollers 72 are driven to rotate by a conveyance motor 33 (see FIG. 3).

The platen 73 is arranged below the scanning mechanism 6 so as to face the nozzle surface 66 of the scanning mechanism 6. The guide member 74 defines a conveyance path 14 for sending the paper 9 sent out from the paper feed tray 4 by the paper feed roller 70 to a region facing the nozzle surface 66 of the recording head 62. The guide member 74 extends from a position near the rear end of the paper feed tray 4 to a position near the pair of conveyance rollers 71.

The paper 9 fed rearward from the paper feed tray 4 by the paper feed roller 70 is directed obliquely upward by an inclined plate 4*b* provided at the rear end of the paper feed tray 4, passes through the conveyance path 14 defined by the guide member 74, and reaches a position where the paper 9 is nipped by the pair of conveyance rollers 71. The paper 9 nipped by the pair of conveyance rollers 71 is conveyed to a region facing the nozzle surface 66 of the recording head 62 by the rotation of the pair of conveyance rollers 71. In a state where the paper 9 conveyed by the pair of conveyance rollers 71 is supported by the platen 73, ink is ejected from nozzles 67 provided on the nozzle surface 66 of the recording head 62 that moves in the scanning direction so that an image is recorded on the paper 9. The paper 9 on which the image is recorded is conveyed forward by the pair of discharge rollers 72 and is discharged onto the discharge tray 5.

Figure 3:
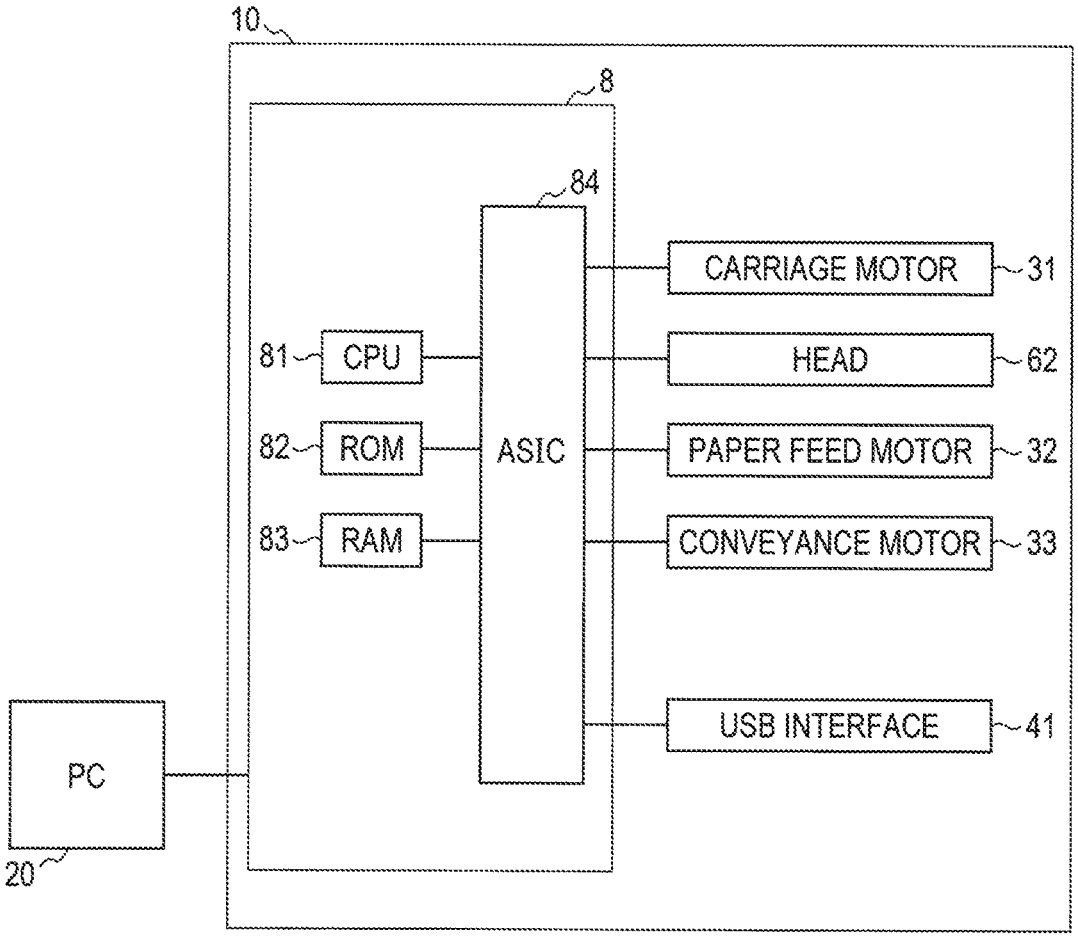
FIG. 3 is a block diagram schematically showing the electrical configuration of the printer shown in FIG. 1 and a PC connected to the printer.

The controller 8 controls the entire printer 10, and as shown in FIG. 3, the carriage motor 31, the recording head 62, the paper feed motor 32, the conveyance motor 33, and so on are electrically connected. Further, a USB interface 41 is electrically connected to the controller 8. The USB interface 41 is a USB standard interface and can be connected to a USB memory as a removable memory. In addition, a PC (Personal Computer) 20 that is an external device is connected to the controller 8 of the printer 10. The printer 10 and the PC 20 may be connected through a LAN (Local Area Network), or may be connected not through the LAN. Further, the data transmission/reception between the printer 10 and the PC 20 may be performed by wireless communication or wired communication. It is also possible to wirelessly connect a portable terminal such as a smartphone to the printer 10 through a LAN or directly.

The controller 8 includes a CPU (Central Processing Unit) 81, a ROM (Read Only Memory) 82, a RAM (Random Access Memory) 83, an ASIC (Applicant Specific Integrated Circuit) 84, and so on. The ROM 82 stores programs executed by the CPU 81 and the ASIC 84, various fixed data, and so on. The RAM 83 stores image data and so on necessary for executing the programs.

The PC 20 has a CPU, a ROM, a RAM, and an HDD (Hard Disk Drive), which are not shown. An OS (Operation System) and a printer driver are installed in the HDD. The CPU controls the operation of the printer 10 by executing the printer driver. The printer driver may be also installed in the ROM of the mobile terminal.

When image data is inputted from a USB memory connected to the USB interface 41 or from the PC 20, the controller 8 causes the CPU 81 and the ASIC 84 to execute various processing including recording processing and conveyance processing based on the program stored in the ROM 82 and on the image data temporarily stored in the RAM 83. With this operation, an image related to the image data is recorded on the paper 9. In the recording processing, the controller 8 controls driving of the carriage motor 31 and the recording head 62 so as to record an image on paper 9 by ejecting ink from the nozzles 67 while moving the recording head 62 in the scanning direction by the scanning mechanism 6. Recording of an image by the printer 10 in one printing processing is performed on a part or an entirety of a range in which an image can be formed by ejecting ink from the nozzles 67 while moving the recording head 62 in the scanning direction (hereinafter referred to as an image formation range). In the conveyance processing, the controller 8 controls the driving of the conveyance motor 33 such that the paper 9 is conveyed in the conveyance direction by the conveyance mechanism 7. The printer 10 of this embodiment records the image related to the inputted image data on the paper 9 by alternately executing the recording processing and the conveyance processing a plurality of times.

Figure 4:
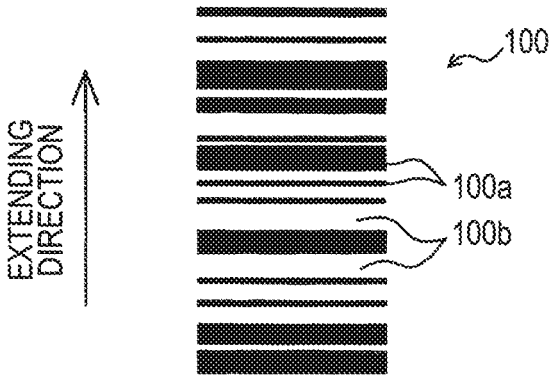
FIG. 4 is an explanatory drawing for illustrating a one-dimensional code image.

Next, the target image data in the present embodiment will be described. As shown in FIG. 4, the image data described in the present embodiment is image data for an image 50 (see FIG. 5A) including a one-dimensional code image 100 formed by a plurality of recorded regions 100*a* and a plurality of non-recorded regions 100*b*. More specifically, each recorded region 100*a* has a bar shape, and the one-dimensional code image 100 has a pattern in which a plurality of recorded regions 100*a* and a plurality of non-recorded regions 100*b* are alternately formed in a particular direction (the direction perpendicular to the longitudinal direction of the recorded region 100*a*). The particular direction in which the plurality of recorded regions 100*a* and the plurality of non-recorded regions 100*b* are alternately formed is the extending direction of the one-dimensional code image 100 (the vertical direction in FIG. 4), and will be simply referred to as "extending direction" in the following description. The present embodiment is directed to the one-dimensional code image 100 formed on the paper 9 such that the extending direction of the one-dimensional code image 100 is the same as the scanning direction.

Each recorded region 100*a* and each non-recorded region 100*b* in the one-dimensional code image 100 have one of a plurality of widths (the size in the arrangement direction) defined by the standard. The width of each recorded region 100*a* and each non-recorded region 100*b* in the one-dimensional code image 100 differs depending on the information to be displayed by the one-dimensional code image 100. In the present embodiment, the one-dimensional code image 100 is a barcode.

Figure 7:
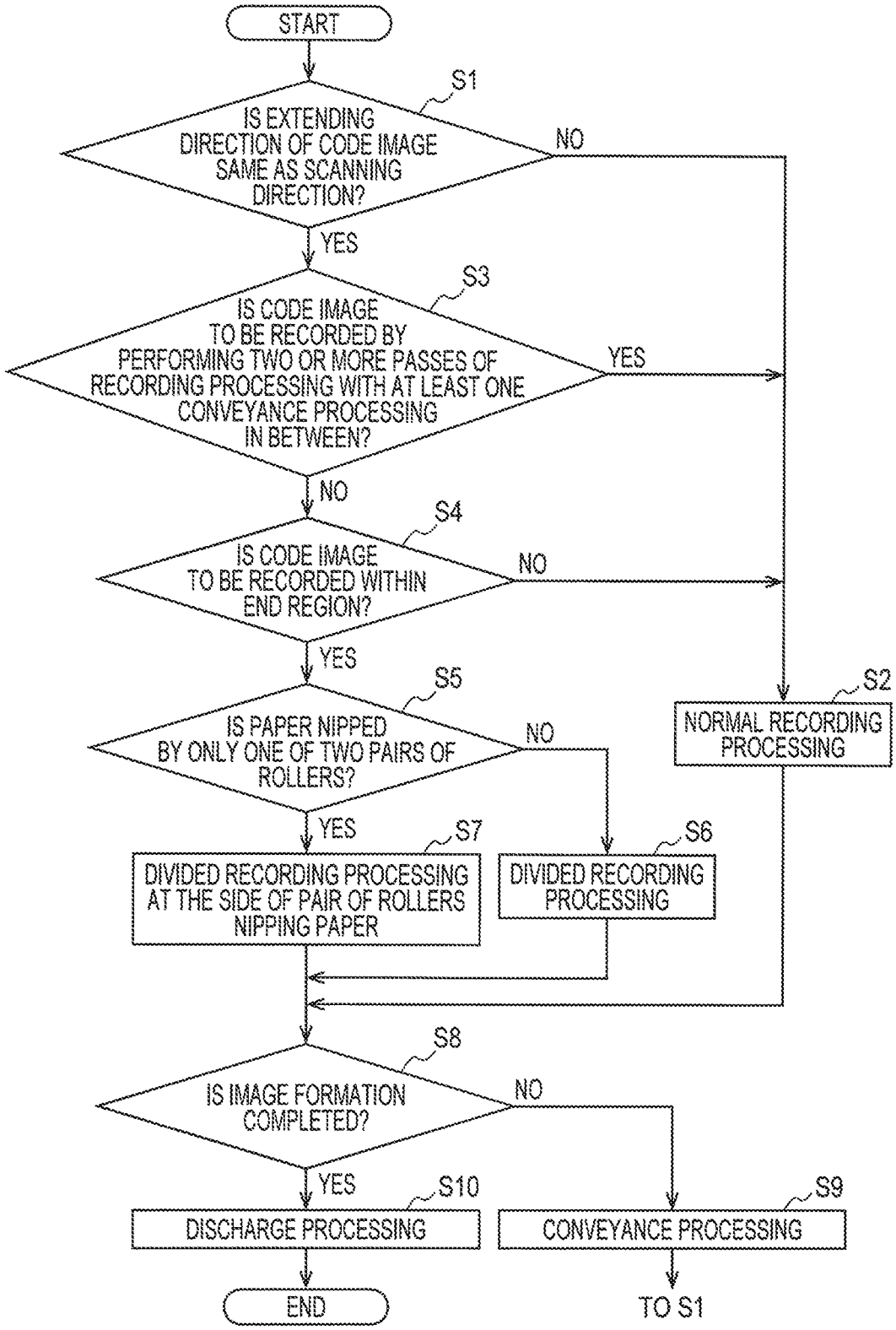
FIG. 7 is a flowchart showing the operations of the inkjet printer according to the first embodiment.

The operation of recording the image 50 on the paper 9 performed by the printer 10 according to the first embodiment will be described next by referring to the flowchart in FIG. 7. The controller 8 performs the following operation in response to input of image data from the PC 20, for example, connected to the printer 10. First, the controller 8 performs code direction determination processing of determining whether the one-dimensional code image 100 is to be formed on the paper 9 such that the extending direction and the scanning direction are the same, within an image formation range of one recording processing performed later (S1).

In response to determining that the one-dimensional code image 100 is formed on the paper 9 such that the extending direction is not the same as the scanning direction within the image formation range or that no one-dimensional code image 100 is formed on the paper 9 (S1: NO), the controller 8 performs normal recording processing (S2) of recording the image 50 on the entirety of the image formation range of the paper 9 by ejecting ink from the nozzles 67 of the recording head 62 during one of the forward movement of the carriage 61 in the FWD direction and the reverse movement of the carriage 61 in the RVS direction performed by the scanning mechanism 6.

In response to determining that the one-dimensional code image 100 is formed on the paper 9 such that the extending direction is the same as the scanning direction within the image formation range (S1: YES), the controller 8 determines whether the length of the one-dimensional code image 100 in the conveyance direction is greater than the length of the image formation range in the conveyance direction (S3). In S3, when recording of the one-dimensional code image 100, on the presumption that an image up to immediately before the one-dimensional code image 100 has been recorded, it is determined whether the one-dimensional code image 100 is to be recorded by performing two or more passes of recording processing with at least one conveyance processing in between, as will be described later.

In response to determining that the length of the one-dimensional code image 100 in the conveyance direction is greater than the length of the image formation range in the conveyance direction (S3: YES), the controller 8 performs the normal recording processing (S2). In this case, in the normal recording processing performed before the conveyance processing, a part of each recorded region 100*a* of the one-dimensional code image 100 is recorded during one of the forward movement and the reverse movement. And, in the normal recording processing performed after the conveyance processing, another part of each recorded region 100*a* of the one-dimensional code image 100 is recorded during the other of the forward movement and the reverse movement.

In response to determining that the length of the one-dimensional code image 100 in the conveyance direction is not greater than the length of the image formation range in the conveyance direction (S3: NO), the controller 8 performs first code position determination processing (S4) of determining whether at least part of the one-dimensional code image 100 is to be recorded in an end region within a particular distance d (see FIG. 5A) from an end (including a left end and a right end) of the paper 9 in the scanning direction.

In response to determining that no part of the one-dimensional code image 100 is recorded in the end region (S4: NO), the controller 8 performs the normal recording processing described above (S2). In response to determining that at least part of the one-dimensional code image 100 is recorded in the end region (S4: YES), the controller 8 first performs image recording up to a position immediately before the one-dimensional code image 100 (namely, up to a position corresponding to a downstream end of the one-dimensional code image 100 in the conveyance direction). Here, when there is no image to be recorded, the controller 8 merely conveys the paper 9. Then, the controller 8 performs second code position determination processing (S5) of determining whether the paper 9 is nipped in only one of the pair of conveyance rollers 71 and the pair of discharge rollers 72 at the time of recording of the one-dimensional code image 100.

In response to determining that the paper 9 is nipped by both the pair of conveyance rollers 71 and the pair of discharge rollers 72 at the time of recording of the one-dimensional code image 100 (S5: NO), the controller 8 performs divided recording processing (S6) on the paper 9 in which a first portion 111 of each recorded region 100*a* of the one-dimensional code image 100 is recorded during the forward movement of the carriage 61 in the FWD direction, and a second portion 112 of each recorded region 100*a* of the one-dimensional code image 100 is recorded during the reverse movement of the carriage 61 in the RVS direction. For example, the first portion 111 corresponds to the downstream half of each recorded region 100*a* in the conveyance direction, and the second portion 112 corresponds to the upstream half of each recorded region 100*a* in the conveyance direction (see FIGS. 5A and 5B).

Figure 5A:
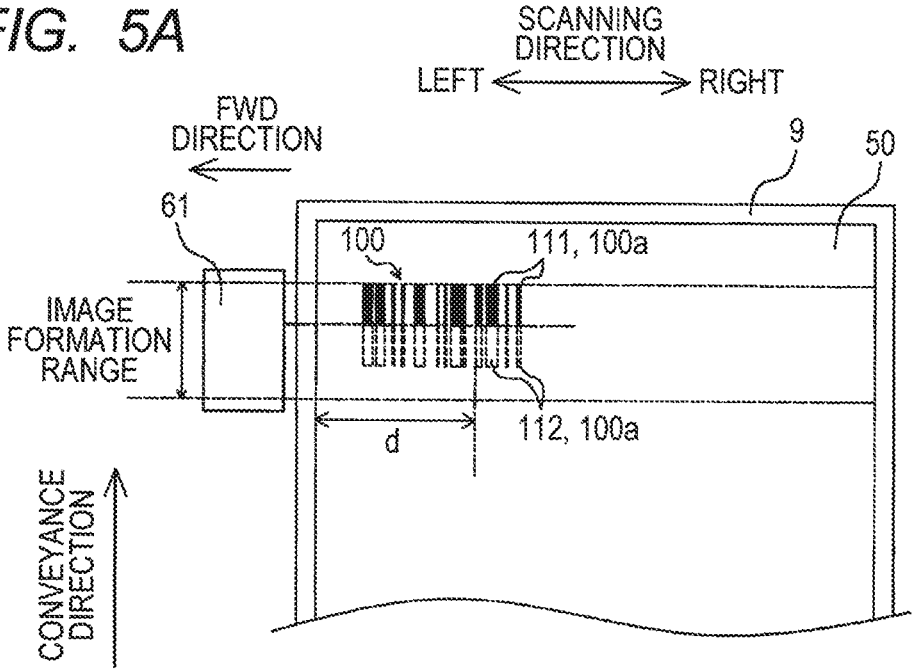
FIG. 5A is an explanatory drawing for illustrating that a one-dimensional code image is recorded by movement in a forward (FWD) direction in divided recording processing according to the first embodiment.
Figure 5B:
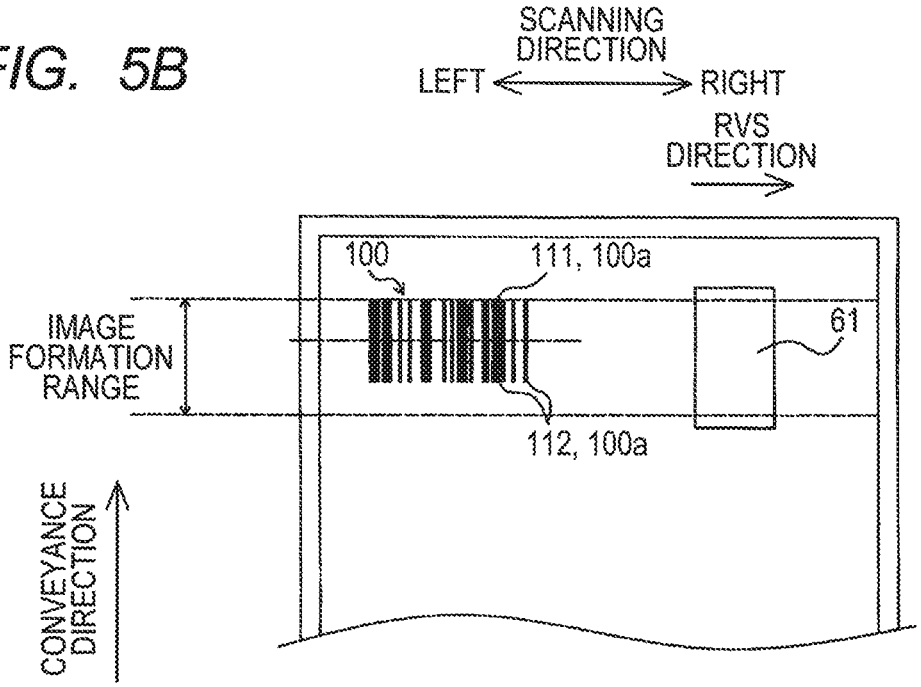
FIG. 5B is an explanatory drawing for illustrating that the one-dimensional code image is recorded by movement in a reverse (RVS) direction in the divided recording processing according to the first embodiment.

The specific operation in the divided recording processing (S6) will be described below by referring to FIGS. 5A and 5B. As shown in FIG. 5A, the controller 8 controls the recording head 62 to eject ink from the nozzles 67 while controlling the carriage motor 31 to make forward rotation to cause the carriage 61 to move in the FWD direction, thereby recording a plurality of first portions 111 on the paper 9 located at the same position in the plurality of recorded regions 100*a* with respect to the conveyance direction. In this embodiment, the first portion 111 means one of a plurality of sections (in this embodiment, two sections) defined by dividing each recorded region 100*a* at a position common to all the recorded regions 100*a* with respect to the conveyance direction. At this time, the recording head 62 ejects ink from the nozzles 67 corresponding to the position of the first portion 111. In FIG. 5A, a part of the recorded region 100*a* not recorded on the paper 9 during the forward movement of the carriage 61 is indicated as a hollow section surrounded by dots. As shown in FIG. 5B, the controller 8 then controls the recording head 62 to eject ink from the nozzle 67 while controlling the carriage motor 31 to make reverse rotation to cause the carriage 61 to move in the RVS direction without performing the conveyance processing, thereby recording a plurality of second portions 112 on the paper 9 located at the same position in the plurality of recorded regions 100*a* with respect to the conveyance direction and different from the position of the first portions 111 with respect to the conveyance direction. In this embodiment, the second portion 112 is the remaining section of each recorded region 100*a* different from the first portion. The recording head 62 ejects ink from the nozzles 67 corresponding to the position of the second portion 112. The illustrations of the guide rails 65*a* and 65*b* are omitted in FIGS. 5A and 5B. In this way, in response to determining that the paper 9 is nipped by both of the two pairs of rollers 71, 72 when recording the code image 100 (S5: NO), the controller 8 performs the divided recording processing such that the plurality of first portions 111 corresponds to the downstream half of the plurality of recorded regions 100*a* in the conveyance direction and that the plurality of second portions 112 corresponds to the upstream half of the plurality of recorded regions 100*a* in the conveyance direction.

In the divided recording processing, recording is performed such that each recorded region 100*a* is formed of one first portion 111 and one second portion 112. In this embodiment, the downstream half of each recorded region 100*a* in the conveyance direction is the first portion 111, and the upstream half of each recorded region 100*a* in the conveyance direction is the second portion 112.

In response to determining that the paper 9 is nipped by only one of the pair of conveyance rollers 71 and the pair of discharge rollers 72 at the time of recording of the one-dimensional code image 100 (S5: YES), the controller 8 performs divided recording processing (S7) of recording a first portion 111' and a second portion 112' with ink ejected from two or more nozzles 67 among the plurality of nozzles 67 of the recording head 62 and closer to one of the pair of conveyance rollers 71 and the pair of discharge rollers 72 nipping the paper 9 than to the other of the pair of rollers not nipping the paper 9.

Figure 6A:
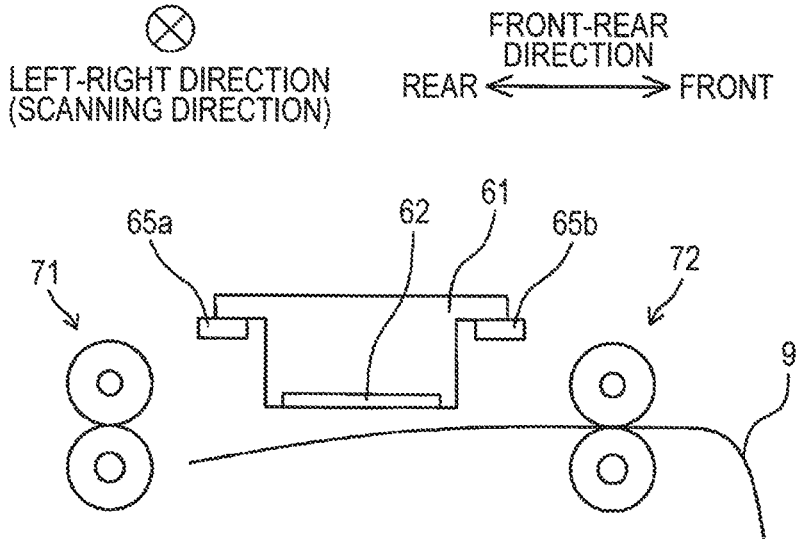
FIG. 6A is an explanatory drawing for illustrating a state where paper is nipped only by a pair of discharge rollers.
Figure 6B:
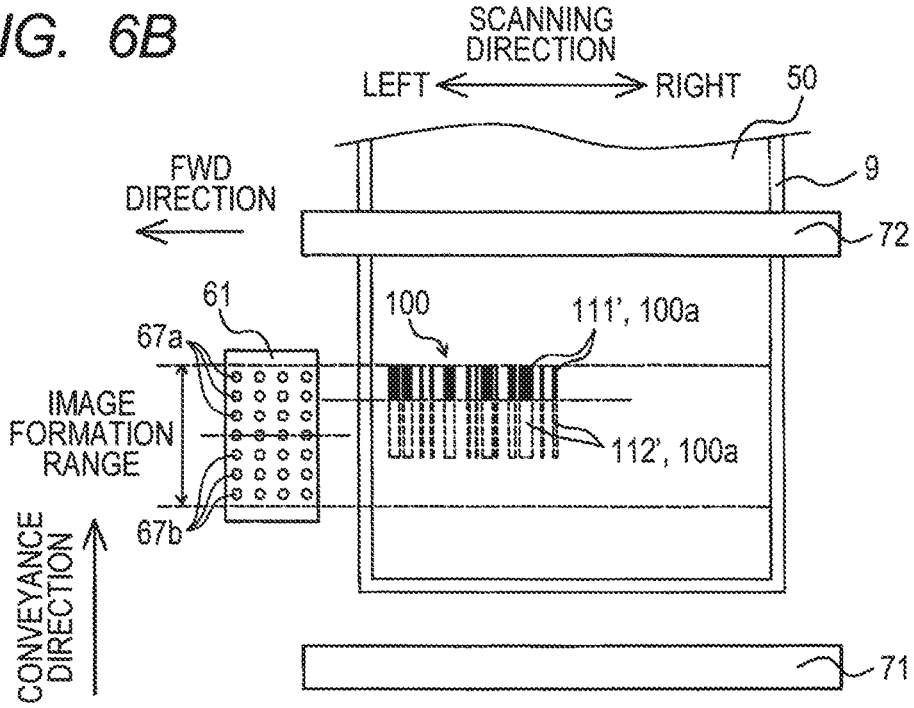
FIG. 6B is an explanatory drawing for illustrating the divided recording processing that is performed in the state of FIG. 6A.

The case in which S7 is performed will be described below. As shown in FIG. 6A, when the one-dimensional code image 100 is recorded in the vicinity of the upstream end of the paper 9 in the conveyance direction, for example, the paper 9 may be nipped only by the pair of discharge rollers 72 at the time of recording of the one-dimensional code image 100. In this case, as shown in FIG. 6B, among downstream nozzles 67*a* of the plurality of nozzles 67 of the recording head 62 and closer to the pair of discharge rollers 72 than to the pair of conveyance rollers 71 (the downstream nozzles 67*a* in the downstream half of the plurality of nozzles 67 in FIG. 6B), the controller 8 uses some of the downstream nozzles 67*a* (the nozzles between the most downstream position of the plurality of nozzles 67 and a position shifted upstream by a quarter (¼) of the image formation range from the most downstream position in FIG. 6B) for recording the first portion 111' during the forward movement of the carriage 61 in the FWD direction. Then, the controller 8 records the second portion 112' during the reverse movement of the carriage 61 in the RVS direction without performing the conveyance processing. In this way, the controller 8 performs the divided recording processing. In the case of FIG. 6B, in order to record the entirety of the one-dimensional code image 100 without performing the conveyance processing, it is required to use both the downstream nozzles 67*a* closer to the pair of discharge rollers 72 than to the pair of conveyance rollers 71 and upstream nozzles 67*b* closer to the pair of conveyance rollers 71 than to the pair of discharge rollers 72. More specifically, in the divided recording processing (S7), the controller 8 records the first portion 111' during the forward movement by using some of the nozzles 67*a*. Then, the controller 8 records the second portion 112' during the reverse movement by using both the remaining downstream nozzles 67*a* (in FIG. 6B, the nozzles between the position shifted upstream by a quarter (¼) of the image formation range from the most downstream position of the plurality of nozzles 67 and a position shifted upstream farther from that position by a quarter (¼) of the image formation range) and the upstream nozzles 67*b*. The illustration of the platen 73 and the guide rails 65*a* and 65*b* are omitted in FIG. 6A and FIG. 6B.

After performing the normal recording processing (S2) or either divided recording processing (S6 or S7), the controller 8 determines whether formation of the image 50 relating to the image data stored in the RAM 83 is completed (S8). In response to determining that formation of the image 50 is not completed (S8: NO), the controller 8 performs the conveyance processing of controlling the conveyance mechanism 7 to convey the paper 9 in the conveyance direction by the length of the image formation range in the conveyance direction (S9), and then returns to S1. In response to determining that formation of the image 50 is completed (S8: YES), the controller 8 performs discharge processing of discharging the paper 9 onto the discharge tray 5 by using the pair of discharge rollers 72 (S10). In this way, the operation of recording the image 50 on the paper 9 by the printer 10 according to the first embodiment is completed.

In a serial type inkjet printer (printer 10), the amount of deviation of the landing position of the ink ejected from the recording head 62 from the desired position in the scanning direction is not constant during forward movement in the FWD direction or reverse movement in the RVS direction and is different depending on the position of the carriage 61. And, the magnitude of variation in the amount of deviation may differ between the forward movement and the reverse movement. For example, during one of the forward movement and the reverse movement of the carriage 61, the posture of the carriage 61 may be tilted to the horizontal direction and the vertical direction. During one of the forward movement and the reverse movement of the carriage 61, the moving speed of the carriage 61 may fluctuate (may be nonuniform). Ejecting ink from the recording head 62 with the carriage 61 in a tilted posture or with nonuniform moving speed of the carriage 61 causes a possibility of deviation of an ink landing position. In this embodiment, when the one-dimensional code image 100 is formed on the paper 9 such that the extending direction and the scanning direction are the same, the divided recording processing is performed in which the first portion 111 or 111' is recorded during the forward movement and then the second portion 112 or 112' is recorded during the reverse movement without performing the conveyance processing. Thus, in either one of the first portion 111, 111' or the second portion 112, 112' of the recorded region 100*a*, variations in the amount of deviation of an ink landing position in the scanning direction are smaller than the other. Hence, it is unlikely that the ratio between the width of the recorded region 100*a* and the width of the non-recorded region 100*b* in the scanning direction goes out of the specified range. Thus, the occurrence of a reading error is suppressed by reading the one-dimensional code image 100 at one of the first portion 111, 111' and the second portion 112, 112' of the recorded region 100*a* where there is less variation in the amount of deviation of an ink landing position in the scanning direction.

In this embodiment, as shown in FIG. 2, the carriage 61 is supported by the two guide rails 65*a* and 65*b* slidably in the scanning direction. The part 25A of the belt 25 is fixed to the upstream end 61U of the carriage 61 in the conveyance direction. By driving the carriage motor 31 and causing the belt 25 wound on the pulleys 23 and 24 on both ends of the guide rail 65 to run, the carriage 61 is moved forward and reversely in the scanning direction. With this structure, the posture of the carriage 61 tends to be different between the forward movement and the reverse movement. Thus, the effect of suppressing the occurrence of a reading error is obtained more significantly.

In this embodiment, the divided recording processing is performed such that each recorded region 100*a* is formed of one first portion 111 and one second portion 112. This simplifies the divided recording processing, compared with a case where each recorded region 100*a* is formed of a plurality of first portions 111 and a plurality of second portions 112.

Immediately after turning from the forward movement to the reverse movement (or from the reverse movement to the forward movement) of the carriage 61, an ink landing position on the paper 9 tends to deviate easily due to the influence of air flow caused by the movement of the carriage 61. Thus, it is effective to perform the divided recording processing when recording the one-dimensional code image 100 in the end region within the particular distance d from an end of the paper 9 in the scanning direction.

As the particular distance d becomes greater, it is more likely that it is determined that the divided recording processing is performed. In this case, the occurrence of a reading error of the one-dimensional code image 100 is further suppressed. On the other hand, compared with the normal recording processing (performed in the case of S4: NO to S2) of recording the one-dimensional code image 100 during only one of the forward movement and the reverse movement, the recording speed is reduced in the divided recording processing. Thus, if priority is given to the recording speed of the image 50 on the paper 9, the particular distance d is preferably small. That is, the particular distance d is set to an appropriate value in consideration of whether priority is given to reduction in the occurrence of a reading error of the one-dimensional code image 100 or priority is given to the recording speed of the entire image 50.

If the paper 9 is nipped by only one of the two pairs of rollers (the pair of conveyance rollers 71 and the pair of discharge rollers 72), the distance between the recording head 62 and the paper 9 increases as the distance from the one of the pair of rollers nipping the paper 9 increases, and the landing accuracy is reduced. In a case where ink is ejected from two or more nozzles 67 that are closer to the pair of rollers nipping the paper 9 than to the other pair of rollers during the forward movement and only the plurality of first portions are recorded and where variation in the amount of deviation of an ink landing position from the desired position in the scanning direction is greater during the forward movement than the variation during the reverse movement, the ink landing accuracy of both the first portion and the second portion is low. The same goes for a case where ink is ejected from two or more nozzles 67 that are closer to the other pair of rollers not nipping the paper 9 during the forward movement and only the plurality of first portions are recorded and where variation in the amount of deviation of an ink landing position from the desired position in the scanning direction is greater during the reverse movement than the variation during the forward movement. In this embodiment, both the first portion 111' and the second portion 112' of each recorded region 100*a* are recorded with ink ejected from the two or more nozzles 67 that are closer to the pair of rollers nipping the paper 9 among the two pairs of rollers 71 and 72. Thus, regarding one of the first portion 111' and the second portion 112', the variation in the amount of deviation is reduced.

Second Embodiment

Figure 8A:
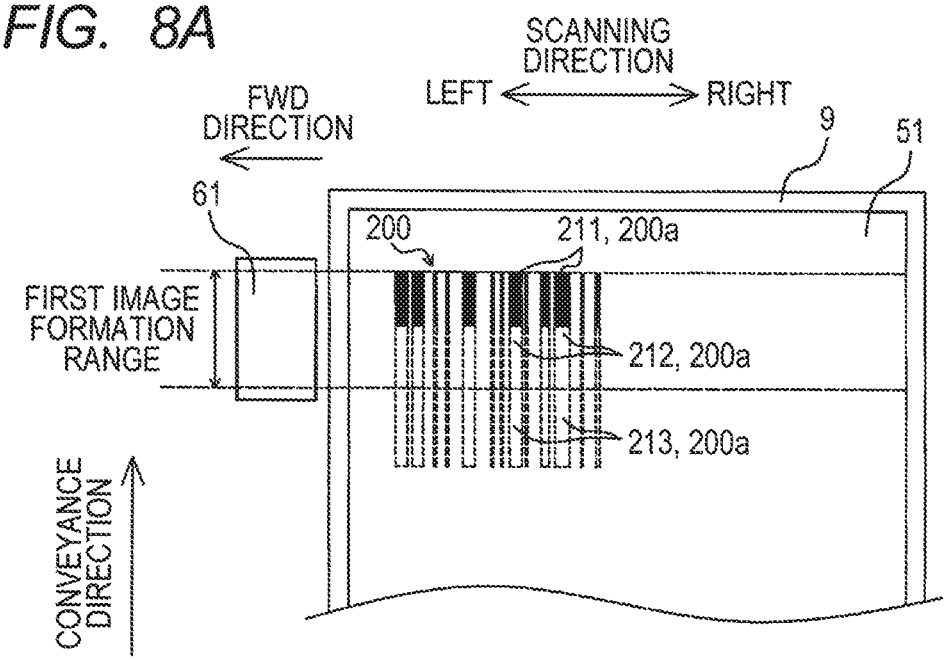
Figure 8B:
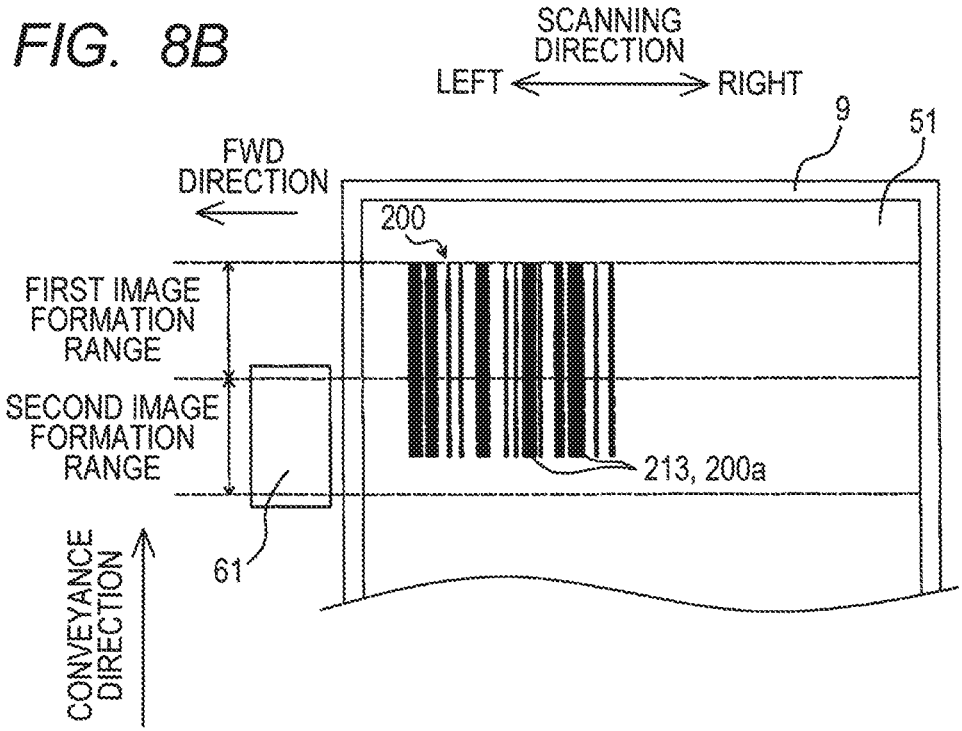
FIG. 8B is an explanatory drawing for illustrating non-divided recording processing that is performed after the conveyance processing in FIG. 8A.
Figure 9:
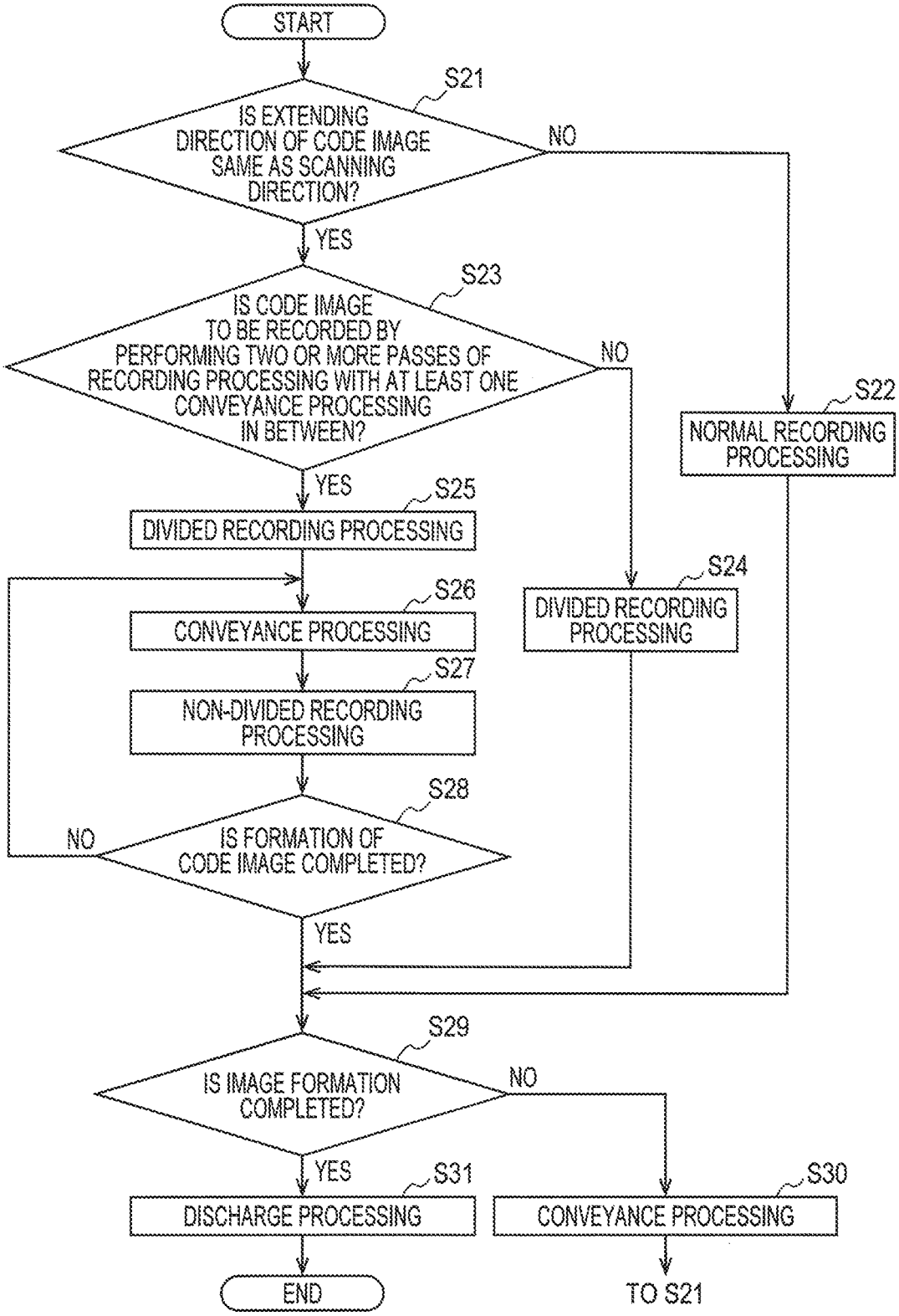
FIG. 9 is a flowchart showing the operations of an inkjet printer according to a second embodiment.

Next, a second embodiment will be described with reference to FIGS. 8 and 9. Hereinafter, components having the same configurations as those of the first embodiment are designated by the same reference numerals, and the description thereof will be appropriately omitted.

The operation of the printer 10 according to the second embodiment when recording the image 51 on the paper 9 will be described below with reference to the flowchart of FIG. 9. The controller 8 performs the following operation when image data is inputted from the PC 20 and so on connected to the printer 10. First, the controller 8 performs code direction determination processing of determining whether a one-dimensional code image 200 is formed on the paper 9 in the direction in which the extending direction of the one-dimensional code image 200 is the same as the scanning direction (S21).

In response to determining that the one-dimensional code image 200 is formed in the direction in which the extending direction is different from the scanning direction or that no one-dimensional code image is formed on the paper 9 (S21: NO), the controller 8 executes normal recording processing of recording the image 51 on the entirety of the image formation range on the paper 9 by ejecting ink from the nozzles 67 of the recording head 62 in either one of the forward movement in the FWD direction and the reverse movement in the RVS direction of the carriage 61 performed by the scanning mechanism 6 (S22).

In response to determining that the one-dimensional code image 200 is formed on the paper 9 in the direction in which the extending direction is the same as the scanning direction (S21: YES), the controller 8 executes third code position determination processing of determining whether the length of the one-dimensional code image 200 in the conveyance direction is longer than the length of the image formation range in the conveyance direction (S23). In the third code position determination processing, when recording of the one-dimensional code image 200, on the presumption that an image up to immediately before the one-dimensional code image 200 has been recorded, it is determined whether the one-dimensional code image 200 is to be recorded by performing two or more passes of recording processing with at least one conveyance processing in between, as will be described later.

In response to determining that the length of the one-dimensional code image 200 in the conveyance direction is less than or equal to the length of the image formation range in the conveyance direction (S23: NO), the controller 8 performs divided recording processing on the paper 9 (S24) as in the first embodiment described above, in which a first portion of each recorded region 200*a* of the one-dimensional code image 200 is recorded by using the downstream nozzles 67*a* during the forward movement of the carriage 61 and a second portion of each recorded region 200*a* of the one-dimensional code image 200 is recorded by using the upstream nozzles 67*b* during the reverse movement without performing the conveyance processing.

In response to determining that the length of the one-dimensional code image 200 in the conveyance direction is greater than the length of the image formation range in the conveyance direction (S23: YES), the controller 8 first performs image recording up to a position immediately before the one-dimensional code image 200 (when there is no image to be recorded, the controller 8 merely conveys the paper 9). As shown in FIG. 8A, the controller 8 thereafter performs one divided recording processing (S25) in a first image formation range in which a first portion 211 of each recorded region 200*a* of the one-dimensional code image 200 is recorded by using the downstream nozzles 67*a* during the forward movement of the carriage 61 and a second portion 212 of each recorded region 200*a* is recorded by using the upstream nozzles 67*b* during the reverse movement without performing the conveyance processing. Next, the controller 8 performs conveyance processing of controlling the conveyance mechanism 7 to convey the paper 9 in the conveyance direction by the length of the image formation range in the conveyance direction (S26). Then, as shown in FIG. 8B, in one of the forward movement and the reverse movement of the carriage 61, the controller 8 performs non-divided recording processing (S27) of recording a part 213 which is the entire remaining part in the image formation range (second image formation range) of the one-dimensional code image 200 defined after performing the conveyance processing once (S26). Here, the part 213 is the remaining part of each recorded region 200*a* except the first portion 211 and the second portion 212.

After performing the non-divided recording processing (S27), the controller 8 determines whether formation of the one-dimensional code image 200 is completed (S28). In response to determining that the one-dimensional code image 200 is not completed (S28: NO), the controller 8 returns to S26 to convey the paper 9 in the conveyance direction by the length of the image formation range. In response to determining that formation of the one-dimensional code image 200 is completed (S28: YES), the controller 8 determines whether formation of the image 51 relating to image data stored in the RAM 83 is completed (S29). After performing the normal recording processing (S22) or the divided recording processing (S24) as well, the controller 8 performs S29.

In response to determining that the formation of the image 51 is not completed (S29: NO), the controller 8 performs the conveyance processing of controlling the conveyance mechanism 7 such that the paper 9 is conveyed in the conveyance direction by the length of the image formation range in the conveyance direction (S30), and then the processing returns to S1. In response to determining that the formation of the image 51 is completed (S29: YES), the controller 8 performs discharge processing of controlling the pair of discharge rollers 72 to discharge the paper 9 onto the paper discharge tray 5 (S31). Then, the operation that the printer 10 of the second embodiment prints the image 51 on the paper 9 is completed.

The recording speed is faster in the non-divided recording processing than in the divided recording processing. In this embodiment, in a case where it is determined that the length of the one-dimensional code image 200 in the conveyance direction is greater than the length of the image formation range in the conveyance direction, the divided recording processing is performed at least once, and the non-divided recording processing is performed at least once after performing the conveyance processing. The occurrence of a reading error can be reduced by performing the divided recording processing, while recording can be performed at high speed by performing the non-divided recording processing.

[Modifications]

While the disclosure has been described in detail with reference to the above aspects thereof, it would be apparent to those skilled in the art that various changes and modifications may be made therein without departing from the scope of the claims.

For example, in the first embodiment, each recorded region 100*a* is formed of one first portion 111 and one second portion 112. Alternatively, each recorded region 100*a* may be formed of a plurality of first portions 111 and a plurality of second portions 112. For example, the plurality of first portions 111 and the plurality of second portions 112 may be arranged alternately in the conveyance direction. In this case, however, the divided recording processing becomes complicated as ink is ejected from a plurality of nozzles 67 corresponding to the positions of the first portions 111 during forward movement of the carriage 61, and ink is ejected from a plurality of nozzles 67 corresponding to the positions of the second portions 112 during reverse movement of the carriage 61. For this reason, each recorded region 100*a* is preferably formed of one first portion 111 and one second portion 112.

In the embodiments described above, the first portion is recorded during forward movement in the FWD direction, and the second portion is recorded during reverse movement in the RVS direction. Alternatively, the first portion may be recorded during forward movement in the RVS direction, and the second portion may be recorded during reverse movement in the FWD direction.

In the embodiments described above, the paper 9 is conveyed in the conveyance direction by the length of the image formation range in the conveyance direction in the conveyance processing. Alternatively, the paper 9 may be conveyed in the conveyance direction by a particular distance different from the length of the image formation range in the conveyance direction.

In the first embodiment, in case where the paper 9 is nipped only by the pair of discharge rollers 72, the divided recording processing is performed by using the downstream nozzles 67*a* closer to the pair of discharge rollers 72. On the other hand, in a case where the paper 9 is nipped only by the pair of conveyance rollers 71, the divided recording processing is performed by using the upstream nozzles 67*b* closer to the pair of conveyance rollers 71.

In the second embodiment, the first code position determination processing may be performed for determining whether at least part of the one-dimensional code image 200 is to be recorded in the end region within the particular distance d from the end of the paper 9 in the scanning direction. In the second embodiment, the second code position determination processing may be performed for determining whether the paper 9 is nipped by only one of the pair of conveyance rollers 71 and the pair of discharge rollers 72 at the time of recording of at least part of the one-dimensional code image 200.

In the second embodiment, in a case where it is determined that the length of the one-dimensional code image 200 in the conveyance direction is greater than the length of the image formation range in the conveyance direction, the divided recording processing is performed once and the non-divided recording processing is performed at least once. Alternatively, in a case where it is determined that the length of the one-dimensional code image 200 in the conveyance direction is greater than the length of the image formation range in the conveyance direction, the divided recording processing may be performed a plurality of times and the non-divided recording processing may be performed at least once. However, if the divided recording processing is performed a plurality of times, the recording speed is reduced. Thus, the divided recording processing is preferably performed only once.

Figure 10:
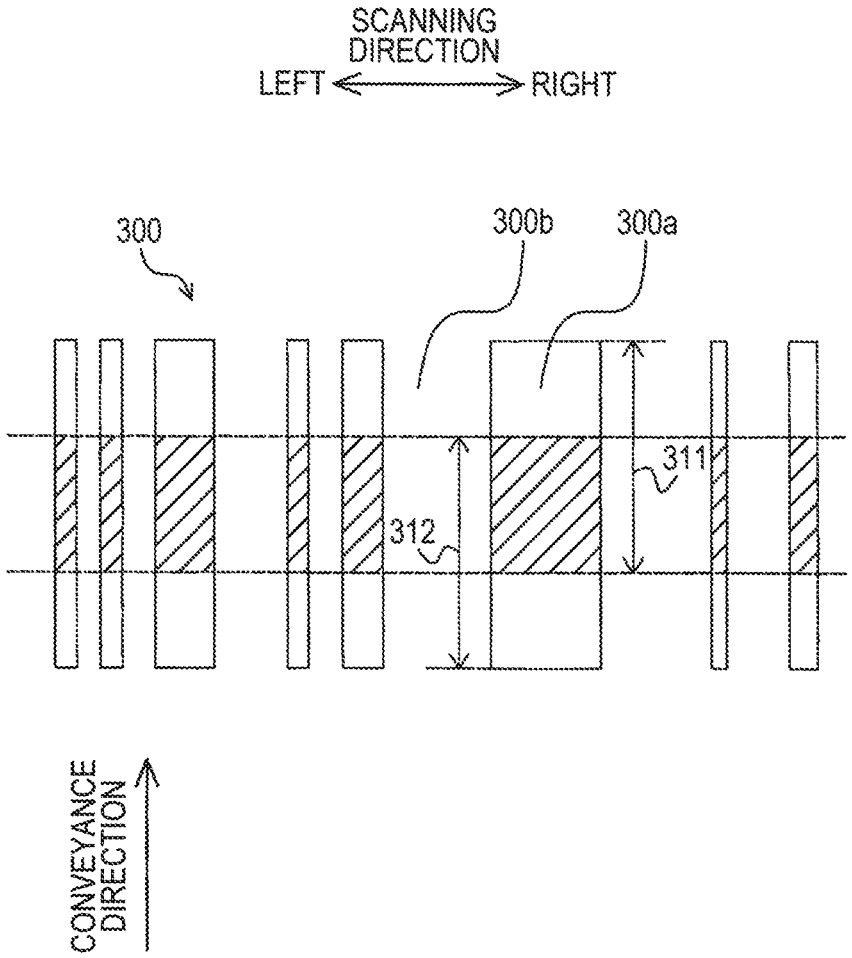
FIG. 10 is an explanatory drawing for illustrating divided recording processing that is performed such that a first portion and a second portion partially overlap in each recorded region.

In the divided recording processing in the embodiments described above, each recorded region is formed such that the first portion and the second portion do not overlap each other. Alternatively, as shown in FIG. 10, each recorded region may be recorded such that a first portion 311 and a second portion 312 partially overlap each other. Here, the area indicated by hatching lines in FIG. 10 shows an area where the first portion 311 and the second portion 312 are recorded such that the sections 311 and 312 overlap each other. By doing so, even when a contrast between a recorded region 300*a* and a non-recorded region 300*b* of a one-dimensional code image 300 is low, a reading error is unlikely to occur.

In the third code position determination processing of the second embodiment, in a case where it is determined that the length of the one-dimensional code image 200 in the conveyance direction is greater than the length of the image formation range in the conveyance direction (S23: YES), the controller 8 performs image recording up to a position immediately before the one-dimensional code image 200. In another case, the controller 8 is not required to perform image recording up to a position immediately before the one-dimensional code image 200. In this case, the controller 8 determines in the third code position determination processing whether the one-dimensional code image 200 is to be recorded with execution of the conveyance processing at least once.

In the above-described first or second embodiment, the controller 8 provided in the printer 10 executes the code direction determination processing, the code position determination processing, the divided recording processing, the non-divided recording processing, the normal recording processing, the conveyance processing, the discharge processing, and so on. However, the present disclosure is not limited to this. For example, a printer driver installed in the HDD of the PC 20 connected to the printer 10 or the ROM of the mobile terminal may cause the PC 20 or the mobile terminal to execute a part or all of these processing.

What is claimed is:

1. A liquid ejection apparatus comprising:

a head having a plurality of ejection ports configured to eject liquid;

a conveyor configured to perform conveyance processing of conveying a recording medium in a conveyance direction;

a carriage on which the head is mounted, the carriage being configured to reciprocate in a scanning direction perpendicular to the conveyance direction; and a controller configured to:

control the conveyor to convey the recording medium in the conveyance direction;

determine whether a code image is to be formed on the recording medium such that a particular direction of the code image is same as the scanning direction, the particular direction being a direction in which a plurality of recorded regions and a plurality of non-recorded regions are formed alternately; and in response to determining that the code image is to be formed such that the particular direction is same as the scanning direction, perform divided recording processing of controlling the head and the carriage to:

(a) record a plurality of first portions with liquid ejected from the head during a first movement of the head in the scanning direction, the plurality of first portions being respective portions of the plurality of recorded regions, the plurality of first portions being located at a same position with respect to the conveyance direction; and (b) record a plurality of second portions with liquid ejected from the head during a second movement of the head in the scanning direction, the plurality of second portions being respective portions of the plurality of recorded regions, the plurality of second portions being located at a same position with respect to the conveyance direction, the plurality of second portions being located at an at least partially different position from the plurality of first portions with respect to the conveyance direction, the second movement being a movement in a direction opposite the first movement, the second movement being performed after the first movement without performing the conveyance processing between the first movement and the second movement.

2. The liquid ejection apparatus according to claim 1, further comprising:

two guide rails each extending in the scanning direction;

a belt having a part extending in the scanning direction; and a drive source configured to cause the part of the belt to reciprocate in the scanning direction, wherein the part of the belt is fixed to an end of the carriage in the conveyance direction; and wherein the carriage is slidably supported by the two guide rails.

3. The liquid ejection apparatus according to claim 1, wherein the controller is configured to perform the divided recording processing such that each of the plurality of recorded regions is formed by one of the plurality of first portions and one of the plurality of second portions.

4. The liquid ejection apparatus according to claim 1, wherein the controller is configured to:

determine whether at least part of the code image is to be recorded within an end region that is located within a particular distance from an end of the recording medium in the scanning direction;

in response to determining that the code image is formed such that the particular direction is same as the scanning direction and determining that the at least part of the code image is to be recorded within the end region, perform the divided recording processing.

5. The liquid ejection apparatus according to claim 1, wherein the conveyor includes two pairs of rollers that are arranged with the head interposed therebetween in the conveyance direction; and wherein the controller is configured to:

determine whether the recording medium is nipped by only one of the two pairs of rollers when recording at least part of the code image; and in response to determining that the recording medium is nipped by only one of the two pairs of rollers when recording the at least part of the code image, perform the divided recording processing such that at least part of each of the plurality of first portions and at least part of each of the plurality of second portions are recorded with liquid ejected from two or more ejection ports among the plurality of ejection ports, the two or more ejection ports being closer to the one of the two pairs of rollers nipping the recording medium than to another one of the two pairs of rollers.

6. The liquid ejection apparatus according to claim 1, wherein the controller is configured to:

determine whether the code image is to be recorded by performing two or more passes of recording processing with at least one conveyance processing in between; and in response to determining that the code image is to be recorded by performing two or more passes of recording processing with at least one conveyance processing in between, perform the divided recording processing at least once and perform non-divided recording processing at least once, the non-divided recording processing being processing of recording an entire region through which the head passes in one of the first movement and the second movement that is performed without the conveyance processing.

7. The liquid ejection apparatus according to claim 1, wherein the controller is configured to perform the divided recording processing such that a first portion and a second portion in each of the plurality of recorded regions partially overlap each other, the first portion being one of the plurality of first portions, the second portion being one of the plurality of second portions.

8. The liquid ejection apparatus according to claim 1, wherein the plurality of ejection ports includes an ejection port array in which ejection ports are arranged in the conveyance direction; and wherein the controller is configured to:

control the conveyor, the carriage, and the head to record an image up to a position immediately before the code image or control the conveyor to convey the recording medium up to the position immediately before the code image; and determine whether a length of the code image in the conveyance direction is greater than a length of an image formation range in the conveyance direction, the length the image formation range being a length of the ejection port array.

9. The liquid ejection apparatus according to claim 1, wherein the conveyor includes two pairs of rollers that are arranged with the head interposed therebetween in the conveyance direction; and wherein the controller is configured to:

determine whether the recording medium is nipped by both of the two pairs of rollers when recording the code image; and in response to determining that the recording medium is nipped by both of the two pairs of rollers when recording the code image, perform the divided recording processing such that the plurality of first portions corresponds to a downstream half of the plurality of recorded regions in the conveyance direction and that the plurality of second portions corresponds to an upstream half of the plurality of recorded regions in the conveyance direction.

10. A non-transitory computer-readable storage medium storing a set of program instructions for a computer of an electronic device that controls a liquid ejection apparatus, the liquid ejection apparatus including a head having a plurality of ejection ports configured to eject liquid, a conveyor configured to convey a recording medium in a conveyance direction, a carriage on which the head is mounted, the carriage being configured to reciprocate in a scanning direction perpendicular to the conveyance direction, and a controller configured to perform conveyance processing of controlling the conveyor to convey the recording medium in the conveyance direction, the set of program instructions, when executed by the computer, causing the electronic device to:

determine whether a code image is to be formed on the recording medium such that a particular direction of the code image is same as the scanning direction, the particular direction being a direction in which a plurality of recorded regions and a plurality of non-recorded regions are formed alternately; and in response to determining that the code image is to be formed such that the particular direction is same as the scanning direction, perform divided recording processing of controlling the head and the carriage to:

(a) record a plurality of first portions with liquid ejected from the head during a first movement of the head in the scanning direction, the plurality of first portions being respective portions of the plurality of recorded regions, the plurality of first portions being located at a same position with respect to the conveyance direction; and (b) record a plurality of second portions with liquid ejected from the head during a second movement of the head in the scanning direction, the plurality of second portions being respective portions of the plurality of recorded regions, the plurality of second portions being located at a same position with respect to the conveyance direction, the plurality of second portions being located at an at least partially different position from the plurality of first portions with respect to the conveyance direction, the second movement being a movement in a direction opposite the first movement, the second movement being performed after the first movement without performing the conveyance processing between the first movement and the second movement.

11. The non-transitory computer-readable storage medium according to claim 10, wherein the set of program instructions, when executed by the computer, causes the electronic device to:

perform the divided recording processing such that each of the plurality of recorded regions is formed by one of the plurality of first portions and one of the plurality of second portions.

12. The non-transitory computer-readable storage medium according to claim 10, wherein the set of program instructions, when executed by the computer, causes the electronic device to:

determine whether at least part of the code image is to be recorded within an end region that is located within a particular distance from an end of the recording medium in the scanning direction;

in response to determining that the code image is formed such that the particular direction is same as the scanning direction and determining that the at least part of the code image is to be recorded within the end region, perform the divided recording processing.

13. The non-transitory computer-readable storage medium according to claim 10, wherein the conveyor includes two pairs of rollers that are arranged with the head interposed therebetween in the conveyance direction; and wherein the set of program instructions, when executed by the computer, causes the electronic device to:

determine whether the recording medium is nipped by only one of the two pairs of rollers when recording at least part of the code image; and in response to determining that the recording medium is nipped by only one of the two pairs of rollers when recording the at least part of the code image, perform the divided recording processing such that at least part of each of the plurality of first portions and at least part of each of the plurality of second portions are recorded with liquid ejected from two or more ejection ports among the plurality of ejection ports, the two or more ejection ports being closer to the one of the two pairs of rollers nipping the recording medium than to another one of the two pairs of rollers.

14. The non-transitory computer-readable storage medium according to claim 10, wherein the set of program instructions, when executed by the computer, causes the electronic device to:

determine whether the code image is to be recorded by performing two or more passes of recording processing with at least one conveyance processing in between; and in response to determining that the code image is to be recorded by performing two or more passes of recording processing with at least one conveyance processing in between, perform the divided recording processing at least once and perform non-divided recording processing at least once, the non-divided recording processing being processing of recording an entire region through which the head passes in one of the first movement and the second movement that is performed without the conveyance processing.

15. The non-transitory computer-readable storage medium according to claim 10, wherein the set of program instructions, when executed by the computer, causes the electronic device to:

perform the divided recording processing such that a first portion and a second portion in each of the plurality of recorded regions partially overlap each other, the first portion being one of the plurality of first portions, the second portion being one of the plurality of second portions.

16. The non-transitory computer-readable storage medium according to claim 10, wherein the plurality of ejection ports includes an ejection port array in which ejection ports are arranged in the conveyance direction; and wherein the set of program instructions, when executed by the computer, causes the electronic device to:

control the conveyor, the carriage, and the head to record an image up to a position immediately before the code image or control the conveyor to convey the recording medium up to the position immediately before the code image; and determine whether a length of the code image in the conveyance direction is greater than a length of an image formation range in the conveyance direction, the length the image formation range being a length of the ejection port array.

17. The non-transitory computer-readable storage medium according to claim 10, wherein the conveyor includes two pairs of rollers that are arranged with the head interposed therebetween in the conveyance direction; and wherein the set of program instructions, when executed by the computer, causes the electronic device to:

determine whether the recording medium is nipped by both of the two pairs of rollers when recording the code image; and in response to determining that the recording medium is nipped by both of the two pairs of rollers when recording the code image, perform the divided recording processing such that the plurality of first portions corresponds to a downstream half of the plurality of recorded regions in the conveyance direction and that the plurality of second portions corresponds to an upstream half of the plurality of recorded regions in the conveyance direction.

* * * * *